US005748171A

United States Patent [19]

Ishizaki et al.

[11] Patent Number: 5,748,171

[45] Date of Patent: May 5, 1998

[54] LIQUID CRYSTAL DISPLAY

[75] Inventors: Akira Ishizaki, Atsugi; Katsuhisa Ogawa, Machida, both of Japan

[73] Assignee: Canon Kabushiki Kaisha, Tokyo, Japan

[21] Appl. No.: 753,046

[22] Filed: Nov. 19, 1996

Related U.S. Application Data

[63] Continuation of Ser. No. 385,723, Feb. 8, 1995, abandoned, which is a continuation of Ser. No. 22,509, Feb. 25, 1993, abandoned.

[30] Foreign Application Priority Data

Feb. 28, 1992 [JP] Japan ..... 4-075880
Feb. 28, 1992 [JP] Japan ..... 4-075978

[51] Int. Cl.[6] ..... G09G 3/36

[52] U.S. Cl. ..... 345/101; 345/88

[58] Field of Search ..... 345/87, 88, 94, 345/96, 101; 348/790, 792; 349/19, 33, 34, 37, 54

[56] References Cited

U.S. PATENT DOCUMENTS 4,319,237 3/1982 Matsuo et al. ..... 340/784
4,626,841 12/1986 Togashi ..... 340/805
4,917,469 4/1990 Ross ..... 345/101
5,119,085 6/1992 Yamazaki ..... 345/96
5,179,371 1/1993 Yamazaki ..... 345/93
5,214,418 5/1993 Fukumura et al. ..... 345/88
5,398,042 3/1995 Hughes ..... 345/101

FOREIGN PATENT DOCUMENTS 0314084 5/1989 European Pat. Off. .
0351253 1/1990 European Pat. Off. .
0428250 5/1991 European Pat. Off. .
0436384 7/1991 European Pat. Off. .
6468795 3/1989 Japan .

*Primary Examiner*—Dennis-Doon Chow
*Attorney, Agent, or Firm*—Fitzpatrick, Cella, Harper & Scinto

[57] ABSTRACT

A liquid crystal display with a pixel matrix has a bias circuit for individually applying a bias voltage to color signals input to a pixel. By individually controlling the bias voltage applied to each color signal according to temperature, undesirable density or color change can be avoided. Further, a bias voltage can be applied to a common electrode and regulated in accordance with an integration of the voltage of a pixel so that the integration result becomes zero, to avoid production of a burning phenomenon.

5 Claims, 14 Drawing Sheets

LIQUID CRYSTAL DISPLAY

This application is a continuation, of Application No. 08/385,723 filed Feb. 8, 1995, now abandoned, which is a continuation of Application No. 08/022,509 filed Feb. 25, 1993, now abandoned.

BACKGROUND OF THE INVENTION

1. Field of the Invention

The present invention relates to a liquid crystal display, and more particularly to a liquid crystal display having a bias voltage applying circuit.

2. Related Background Art

Conventionally, in liquid crystal displays, in particular liquid crystal displays using a TN liquid crystal, the AC driving has been made in which the display signal voltage is inverted for every frame, in order to prevent the so-called burning (sticking) of liquid crystal. That is, by inverting the drive signal with an inversion circuit for every frame, for example, the pixel driven by the plus drive signal at the n-th frame will be driven by the minus drive signal at the n+1-th frame.

In the AC drive, to prevent the degradation of image quality due to flickering, as well as preventing surely the burning, it is critical to adjust the voltage so that the pixel voltages with plus and minus drive signals may be offset.

However, only by inverting the drive signal in the inversion circuit, it is difficult to adjust the pixel voltage automatically and assuredly so that the pixel voltages with plus and minus drive signals may be offset.

Since the relation between the applied voltage and the transmittance of liquid crystal varies with the temperature, it is necessary to adjust the voltage of the drive signal in accordance with the change in temperature to obtain more excellent image display.

Generally, liquid crystal color display devices comprise a matrix circuit for outputting each of three primary color signals on the basis of the bright signal and the color signal, a γ-transformation circuit for providing a non-linearity corresponding to the relation between the applied voltage and the transmittance of liquid crystal used in a pixel to each of three primary color signals output from this matrix circuit, and a bias generation circuit for applying a voltage corresponding to an area where the transmittance of the liquid crystal used in the pixel does not vary to each of γ-transformed three primary color signals.

By the way, because the relation between the applied voltage and the transmittance of liquid crystal varies with the temperature, it is necessary to make adjustment in accordance with the variation in outside air temperature and the generated heat of the device itself.

Conventionally, in order to dissolve troubles of making such adjustment manually, it has been proposed that a reference power source with a temperature coefficient equal in absolute value to that at a certain black level voltage is provided, and the voltage of bright signal is automatically adjusted on the basis of output voltage of the reference power source (Japanese Laid-Open Patent Application No. 64-68795). That is, this proposal is that the automatic adjustment to cope with the temperature change is made commonly for three primary color signals to obtain final three primary color signals.

However, the relation between the applied voltage to the pixels and the transmittance with each of three primary color lights may be different depending on the color of light.

FIGS. 13 and 14 show the relation between the retardation and the transmittance with each of the lights having different wavelengths, when displayed in black color, wherein the retardation of the liquid crystal (liquid crystal intervening thickness x birefringence index of liquid crystal) is represented in the transverse axis, and the transmittance of the liquid crystal is represented in the longitudinal axis. As can be clear from the relation, supposing that three primary color pixels are formed in the same condition, the transmittances with three primary color lights are different. Accordingly, when the three primary color signals are commonly adjusted as conventionally performed, color may appear on a site which is to be displayed as black, for example, notwithstanding that automatic adjustment to cope with the change in temperature is made.

SUMMARY OF THE INVENTION

It is an object of the present invention to provide a-liquid crystal display in which an image can be displayed more stably by providing a bias voltage applying circuit.

It is another object of the present invention to provide a liquid crystal display in which in the AC driving of liquid crystal display, the voltage can be adjusted automatically and securely so that the pixel voltages with plus drive signal and minus drive signal can be offset.

It is a further object of the present invention to provide a liquid crystal display in which the automatic adjustment to cope with the change in temperature can be optimally made for each of three primary colors.

It is a still further object of the present invention to provide a liquid crystal display having a plurality of pixels, characterized by comprising a bias circuit for applying a bias voltage to a signal to be input to a pixel, or the pixel.

DETAILED DESCRIPTION OF THE PREFERRED EMBODIMENTS

A first embodiment of the present invention is a liquid crystal display in which a plurality of pixels are AC driven, characterized by comprising an integration circuit for integrating the pixel voltage for integer periods, and a bias circuit for applying to pixel a bias voltage by which the integration result becomes zero when the integration result of the integration circuit is not equal to zero.

A second embodiment of the present invention is a liquid crystal display characterized by comprising:

a temperature detection element for detecting the temperature of a display unit, a γ-transformation circuit for γ-transforming each of three primary color signals, a γ-transformation control circuit for controlling a γ-transformation circuit so that each of three primary color signals may be γ-transformed based on the relation between the applied voltage to the pixels and the transmittance with each of three primary color lights at the temperature detected by the temperature detection element, and a bias circuit for applying to each of three primary color signals a voltage corresponding to each pixel voltage area where the transmittance with each of three primary color lights does not change at the temperature detected by the temperature detection element as a bias for each of three primary color signals.

First of all, the first embodiment of a liquid crystal display according to the present invention will be described.

Referring to FIGS. 1 to 4, the first embodiment of the invention will be described.

Figure 1:
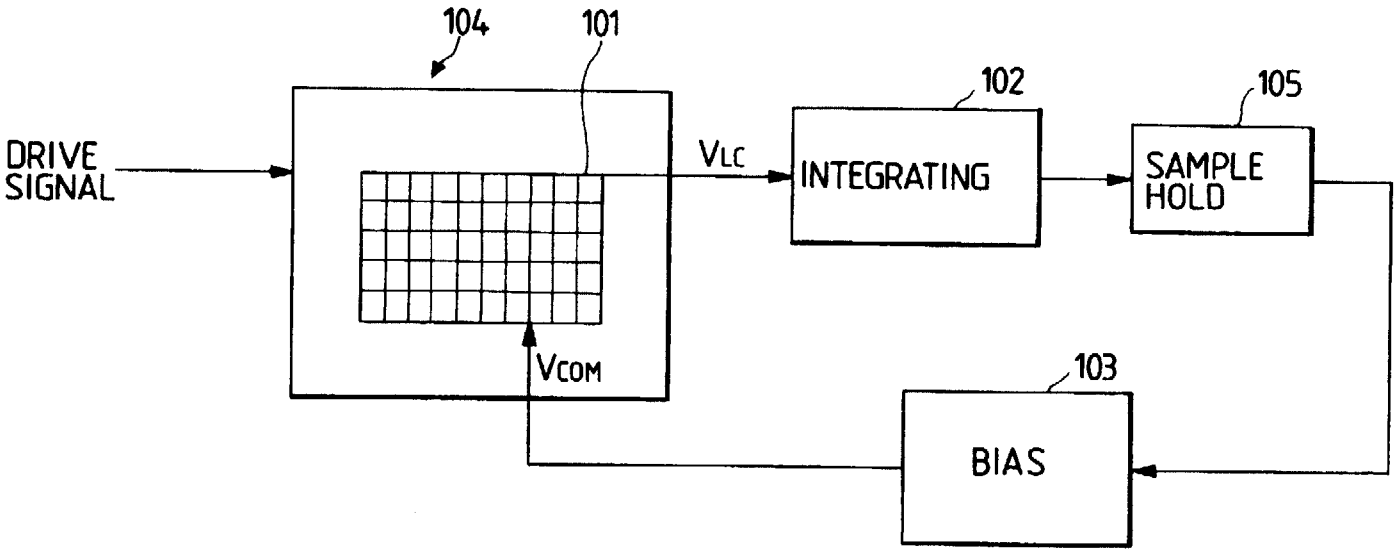
FIG. 1 is a schematic block diagram showing an embodiment of a liquid crystal display according to the present invention.

As shown in FIG. 1, a display unit 104 has a plurality of pixels 101 arranged, with one of the pixels 101 connected to an integration circuit 102. The integration circuit 102 is connected to a sample and hold circuit 105, which is in turn connected to a bias circuit 103.

Figure 2:
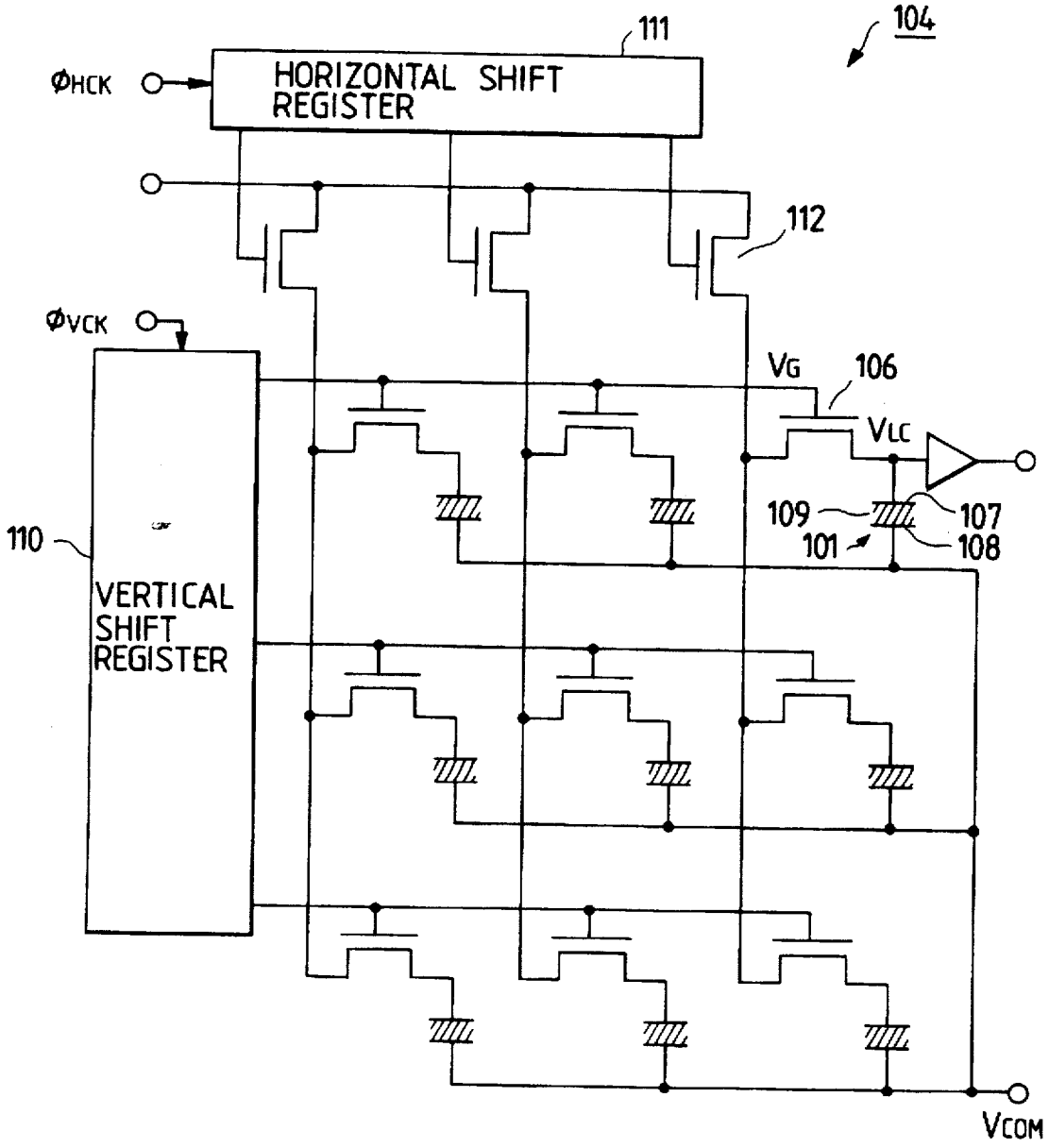
FIG. 2 is an enlarged circuit diagram of a display unit as shown in FIG. 1.

The constitution of the display unit 104 is the same as that of the conventional display unit as shown in FIG. 2, each pixel 101 having a liquid crystal 109 sandwiched between a pixel electrode 107 connected to a driving transistor 106 and a common electrode 108 connected to the common voltage VCOM. Also, each pixel 101 is matrix driven by a vertical shift register 110 for selecting the drive line, and a horizontal shift register 111 for turning on/off an input transistor 112 for outputting a drive signal to each pixel 101 of the selected line at a predetermined timing. Note that $\phi_{VCK}$ is a timing pulse for shifting the vertical shift register, $\phi_{HCK}$ is a timing pulse for shifting the horizontal shift register, and $V_G$ is a gate voltage.

Moreover, the drive condition will be described. The writing is performed by the plus drive signal, for example, for each line selected by the vertical shift register 110, and after this writing for each line is terminated over an entire screen (one frame), the writing is performed for each line of one frame at the reverse voltage to that previously performed, i.e., minus drive signal, whereby this driving with plus and minus drive signals is alternately repeated for each frame.

That is, the AC driving in this embodiment is performed with the writing at the n-th frame and the writing at the n+1-th frame as one period.

In this embodiment, all the pixels 101 are usable for the image display, wherein one pixel is connected to the integration circuit 102 as shown in FIG. 1. This integration circuit 102 integrates the pixel voltage $V_{LC}$ of the pixel 101 connected thereto, and is connected between the drive transistor 106 and the pixel electrode 107. Also, the bias circuit 103 as shown in FIG. 1 is connected to the common electrode 108 connected to the common to adjust the common electrode voltage $V_{COM}$ by applying the bias voltage.

Figure 3:
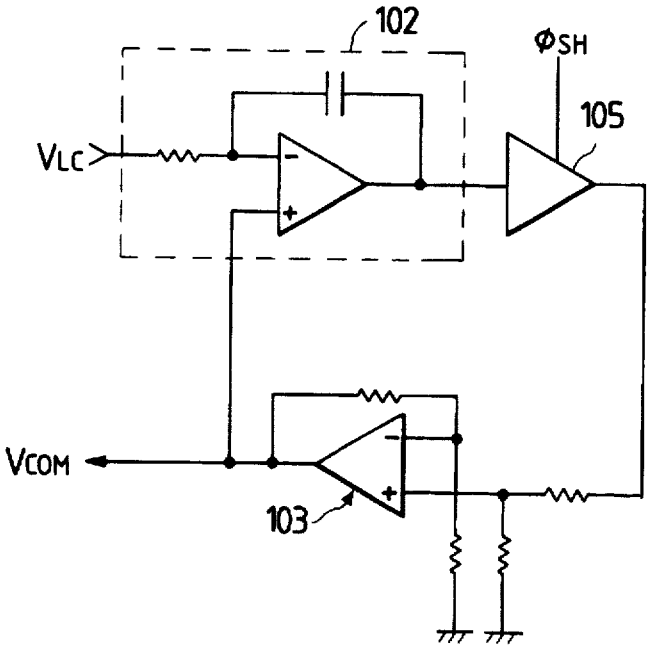
FIG. 3 is a schematic circuit diagram showing one embodiment of an integration circuit and a sample and hold circuit.

FIG. 3 shows a specific constitution of the integration circuit 102, the sample and hold circuit 105, and the bias circuit 103 as shown in FIG. 1.

The integration circuit 102 integrates the pixel voltage $V_{LC}$ of the pixel 101 connected thereto, whereby its integration result is held in the sample and hold for one period of the AC driving.

The sample and hold circuit 105 outputs at a timing pulse $\phi_{SH}$ upon termination of one period of the AC driving. At this time, the integration result over one period of the AC driving is offset between the first half period and the next half period in which the voltage of drive signal applied to the liquid crystal 109 is inverse to each other, whereby when it is zero, the output from the sample and hold circuit 105 is equal to zero, while when it is not zero because the pixel voltages $V_{LC}$ with plus drive signal and minus drive signal are not offset, its difference is output.

The bias circuit 103 receives an output from the sample and hold circuit 105, and when the pixel voltages $V_{LC}$ with plus drive signal and minus drive signal are not offset, it outputs a bias voltage for adjusting the voltage so that the difference is zero. And in a state where this bias voltage is applied, the pixel voltage $V_{LC}$ is further integrated over one period, and the output from the bias circuit 103 is adjusted again based on this result. Thereby the above operation is repeated.

Figure 4:
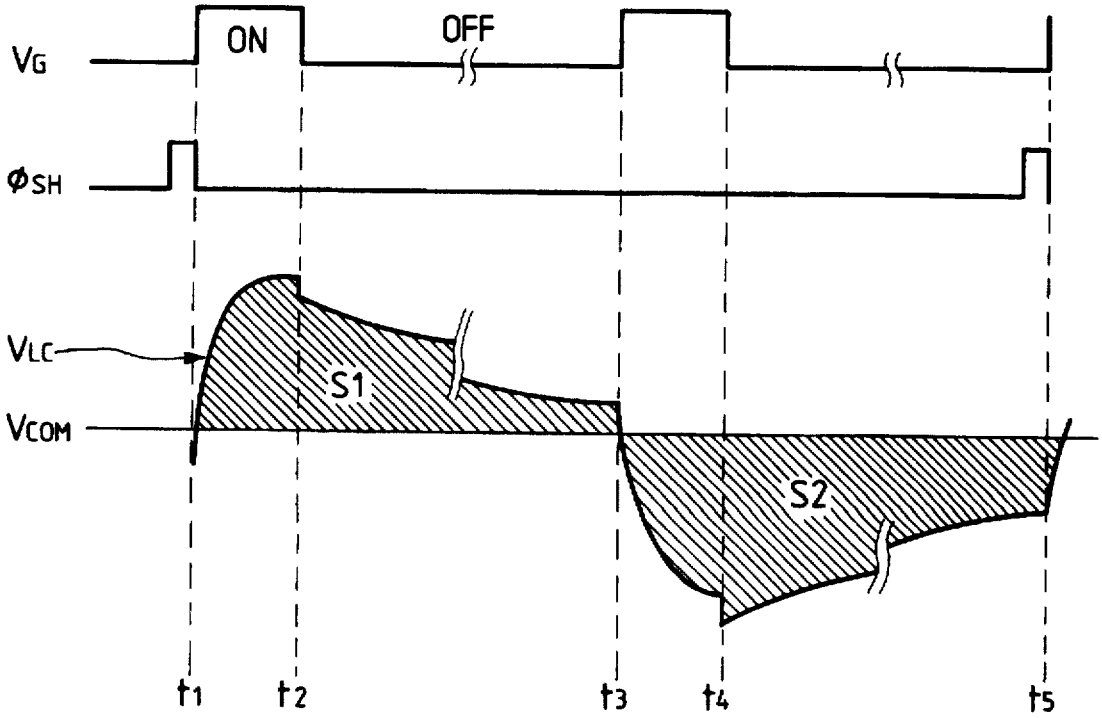
FIG. 4 is a timing chart of the gate voltage, the timing pulse to the sample and hold circuit, and the pixel voltage.

Further, referring to FIG. 4, first, at time $t_1$, the gate voltage $V_G$ gets high, and the drive transistor 106 (see FIG. 2) turns on, whereby the liquid crystal 109 (see FIG. 2) is charged to a capacitance.

After the charging, at time $t_2$, the gate voltage $V_G$ gets low, and the drive transistor 106 turns off, whereby the pixel voltage $V_{LC}$ will decrease owing to fluctuation in the gate voltage $V_G$ (particularly in the case of nMOS).

From $t_2$ to $t_3$, the pixel voltage $V_{LC}$ gradually-decreases due to leakage. And at time $t_3$, the gate voltage $V_G$ gets high again, and the drive transistor 106 turns on, whereby the liquid crystal 109 is charged upon a drive signal at an inverse voltage to that of charging from $t_1$ to $t_2$, as above described.

Thereafter, after being subjected to fluctuation in the gate voltage $V_G$ at time $t_4$, the pixel voltage $V_{LC}$ changes due to leakage from $t_4$ to $t_5$, as previously described.

As the fluctuation in the pixel voltage $V_{LC}$ as shown in FIG. 4 is involved in the liquid crystal display over one period of the AC driving as shown in FIGS. 1 and 2, discharging on the plus side and discharging on the minus side are repeated with the common electrode voltage $V_{COM}$ as a reference. Note that in the present invention, the plus side and the minus side are on the reference of this common electrode voltage $V_{COM}$.

The integration circuit 102 (see FIGS. 1 and 3) integrates the areas $S_1$, $S_2$ as indicated by the slant line in FIG. 4.

The sample and hold 105 (see FIGS. 1 and 3) holds the output from the integration circuit 102 until a timing pulse $\phi_{SH}$ is input, so that the area $S_1$ and the area $S_2$, which are integration results having opposite signs, may be offset. When the integration values are not offset due to the difference between the area $S_1$ and the area $S_2$, that is, when the pixel voltages $V_{LC}$ with plus and minus drive signals are not offset, a signal corresponding to this difference is output based on a timing pulse $\phi_{SH}$.

The bias circuit 103 (see FIGS. 1 and 3) receives the output from the sample and hold circuit 105 to increase or decrease the common electrode voltage $V_{COM}$ so that the area $S_1$ and the area $S_2$ are equal in size.

While in the above explanation, the pixel voltage $V_{LC}$ is adjusted by integrating over one period of AC driving, but not limited to one period, it will be appreciated that it is possible to make adjustment based on a result of integrating the pixel voltage $V_{LC}$ over a plurality of periods in order to improve the adjustment precision.

Figure 5:
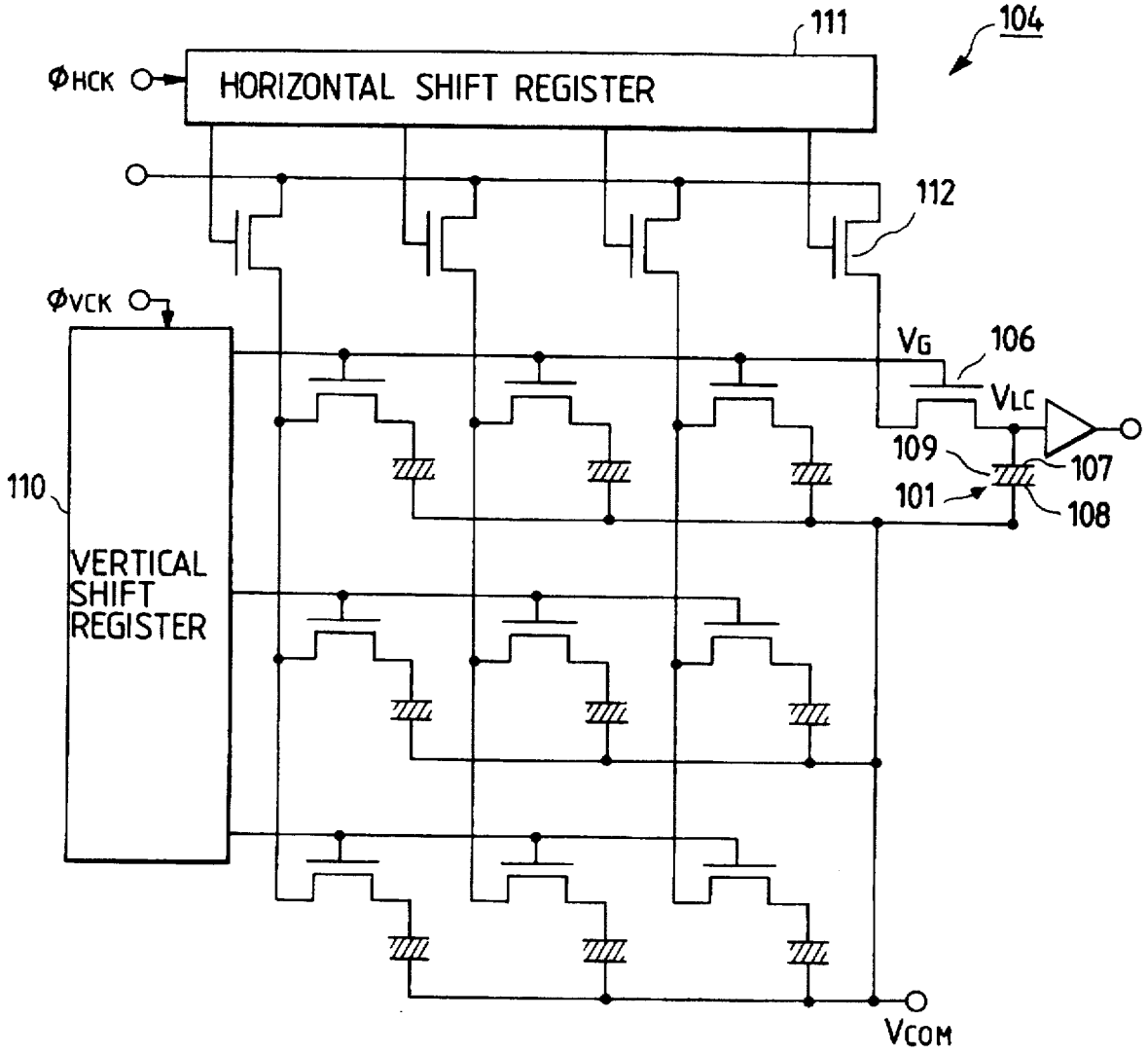
FIG. 5 is an enlarged circuit diagram of a display unit in one embodiment of a liquid crystal display according to the present invention.

FIG. 5 shows a second embodiment according to the present invention, which is the same as the first embodiment as previously described, except that a pixel dedicated for sampling which is not used for the display is prepared as the pixel 101 connecting to the integration circuit 102 (see FIGS. 1 and 3) for integrating the pixel voltage $V_{LC}$, wherein like numerals refer to like components.

With such a constitution, the display state can be prevented from being affected by the connection between the integration circuit 102 and the pixel 101.

Figure 6:
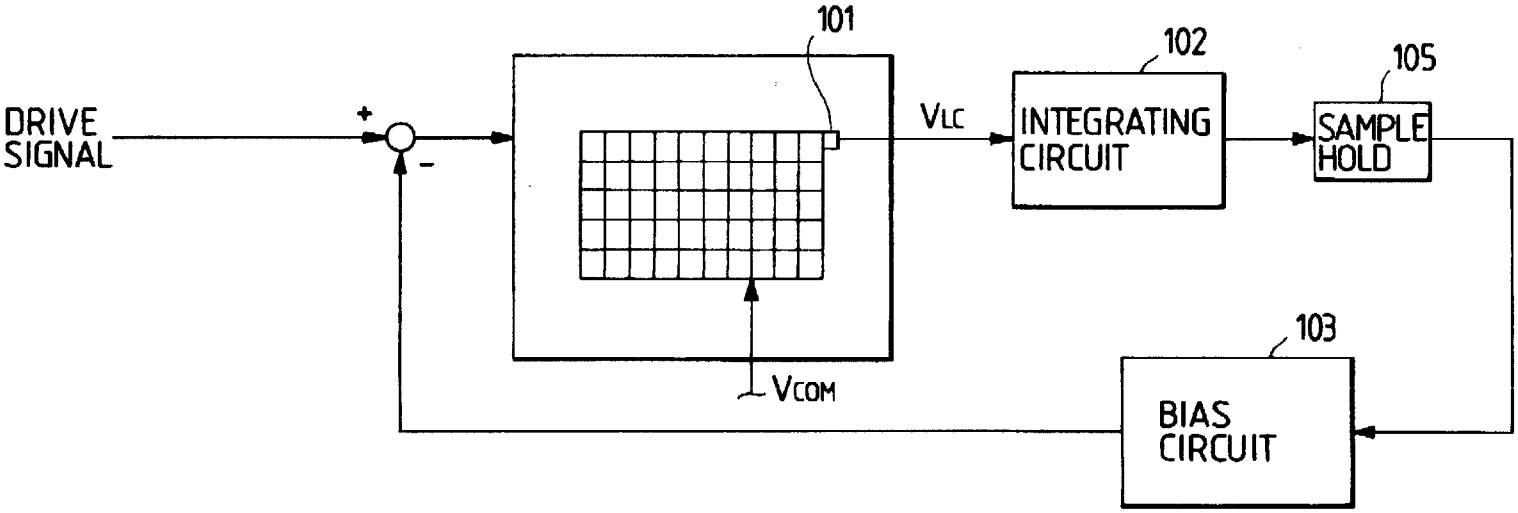
FIG. 6 is a schematic block diagram showing an embodiment of the present invention.

FIG. 6 shows a third embodiment according to the present invention, which is the same as the first embodiment, except that a pixel 101 dedicated for sampling is provided and the output from the bias circuit 103 is applied to the drive signal.

Moreover, while in the first embodiment, adjustment is made by applying a bias voltage to the common electrode voltage $V_{COM}$ which is a reference of dividing into the area $S_1$ and the area $S_2$ as shown in FIG. 4, in this embodiment, the variation curve itself of the pixel voltage $V_{LC}$ is changed for the adjustment. Also, the common electrode voltage $V_{COM}$ in this embodiment is held constant during the driving.

The first embodiment of the invention can securely prevent the burning without any flickers because in the AC driving, the voltage is automatically adjusted so that-the pixel voltages $V_{LC}$ with plus and minus drivings be offset. Also, in the liquid crystal display having a function of automatically adjusting the voltage of drive signal based on the change in temperature, it is possible to make adjustment of the pixel voltage in the AC driving.

A fourth embodiment of the present invention will be described below.

Figure 7:
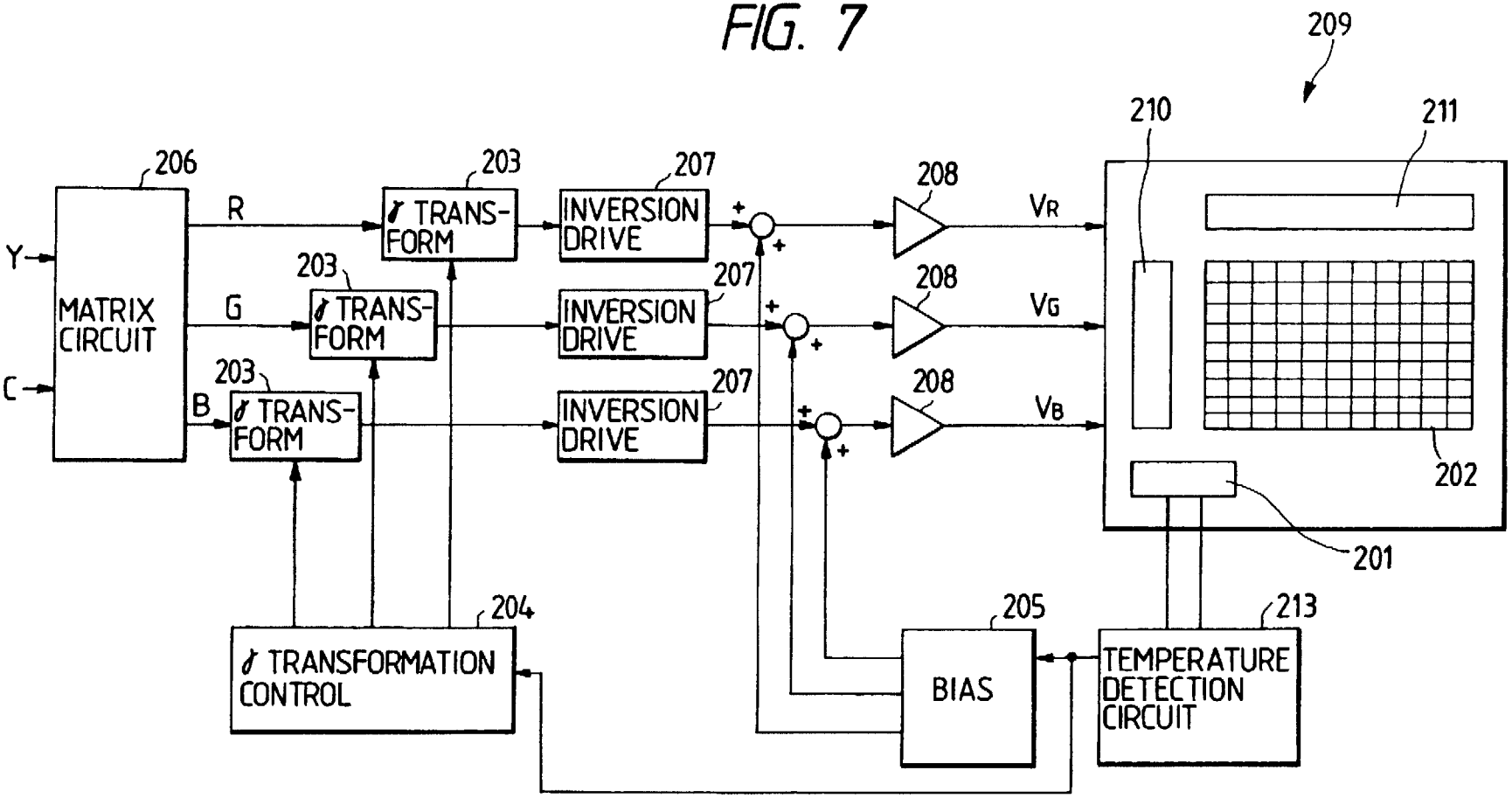
FIG. 7 is a schematic block diagram showing an embodiment of a liquid crystal display according to the present invention.

FIG. 7 shows a fourth embodiment of the present invention, wherein 206 is a matrix circuit for outputting three primary color signals (R: red, G: green, B: blue) on the basis of a bright signal Y and a color signal C.

The matrix circuit 206 is connected to three γ-transformation circuits 203 provided corresponding to three primary color signals. The γ-transformation circuit 203 gives a non-linear characteristic to each of the three primary color signals, because the relation between the applied voltage and the transmittance of liquid crystal used is not linear, but non-linear as shown in FIG. 12.

The γ-transformation circuits 203 are connected to respective inversion drive circuits 207. The inversion drive circuit 207 inverts the signal sign with reference to the common electrode voltage for each period to cause alternately the positive drive and the negative drive of the pixels 202 for each period. The inversion drive circuit 207 is to prevent the so-called burning caused by driving the pixels 202 only on the positive or negative side, for example, when a TN liquid crystal is used as the liquid crystal.

Each of three primary color signals output from the -inversion drive circuit 207 is input to a respective liquid crystal drive voltage conversion circuit 208, after the addition of a bias voltage by the bias circuit 205.

Figure 12:
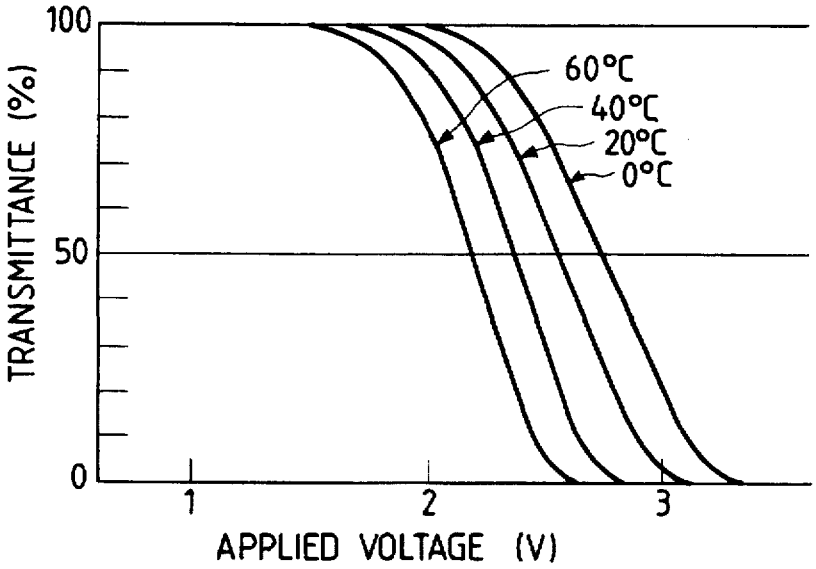
FIG. 12 is graphs showing the relation between the applied voltage and the transmittance of liquid crystal.

As can be seen from FIG. 12, there is normally a voltage area or range in the liquid crystal, where the transmittance does not change (about 1.5 V in FIG. 12). Therefore, to vary the transmittance of the liquid crystal, it is necessary to apply a voltage above that range to the liquid crystal, i.e., the pixels 202. The bias circuit 205 adds a bias voltage corresponding to the voltage area to each of the three primary color signals, so that the voltage above that in the voltage area may be applied to each of the three primary color signals. Also, the liquid crystal drive voltage conversion circuits 208 output the drive signals $V_R$, $V_G$, $V_B$ corresponding to three primary color signals to the display unit 209.

Figure 8:
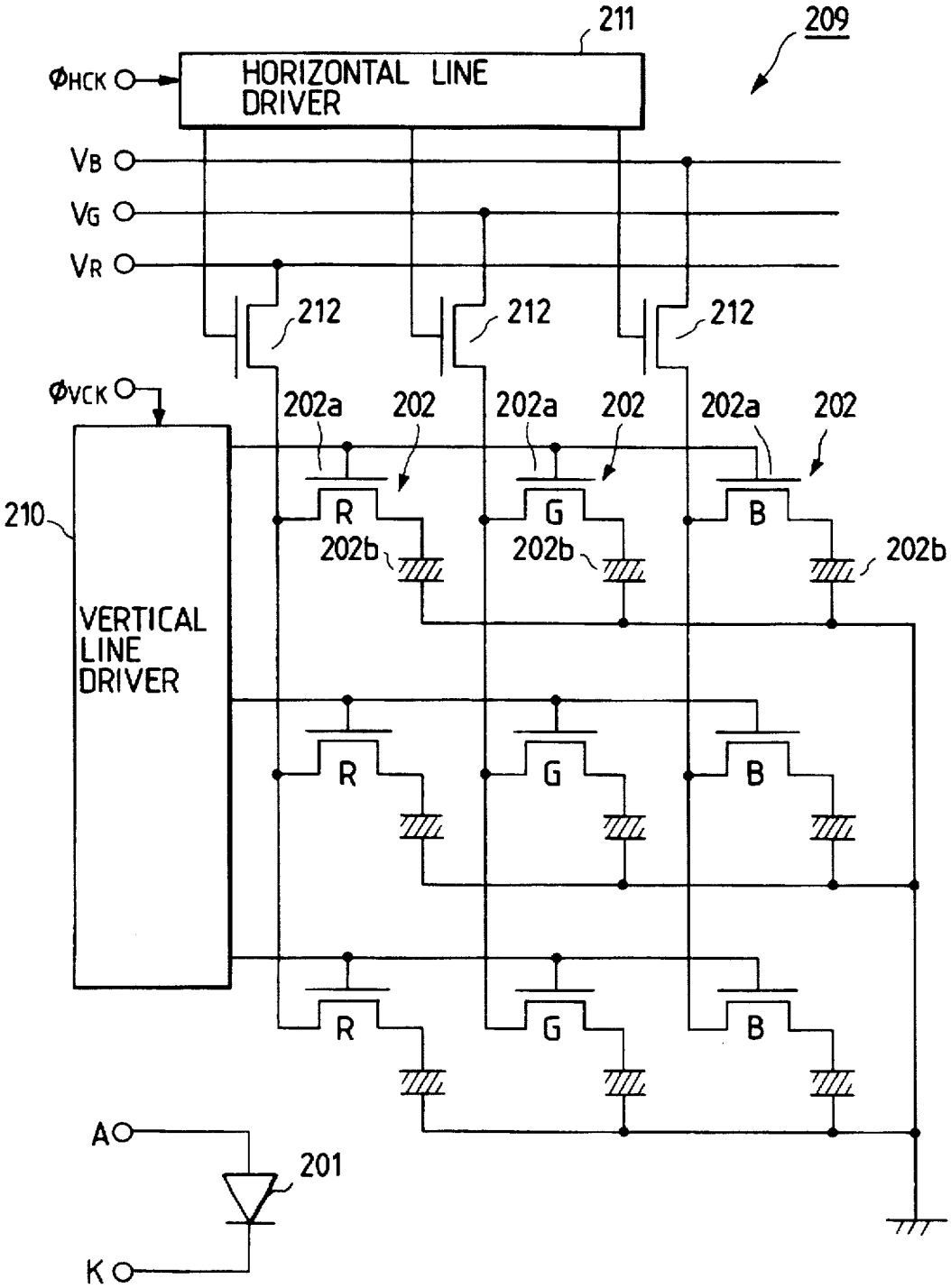
FIG. 8 is an equivalent circuit diagram of a display unit as shown in FIG. 7.

The display unit 209 comprises the pixels 202 of R, G and B a vertical line driver 210 and a horizontal line driver 211 for driving those pixels, and data line input switches 212 for turning on/off each of the drive signals $V_R$, $V_G$, $V_B$, as shown in FIG. 8. In particular, besides these, the present invention is provided with a temperature detection element 201. Note that **202*a* is a drive transistor and 202*b*** is a liquid crystal layer.

Figure 9:
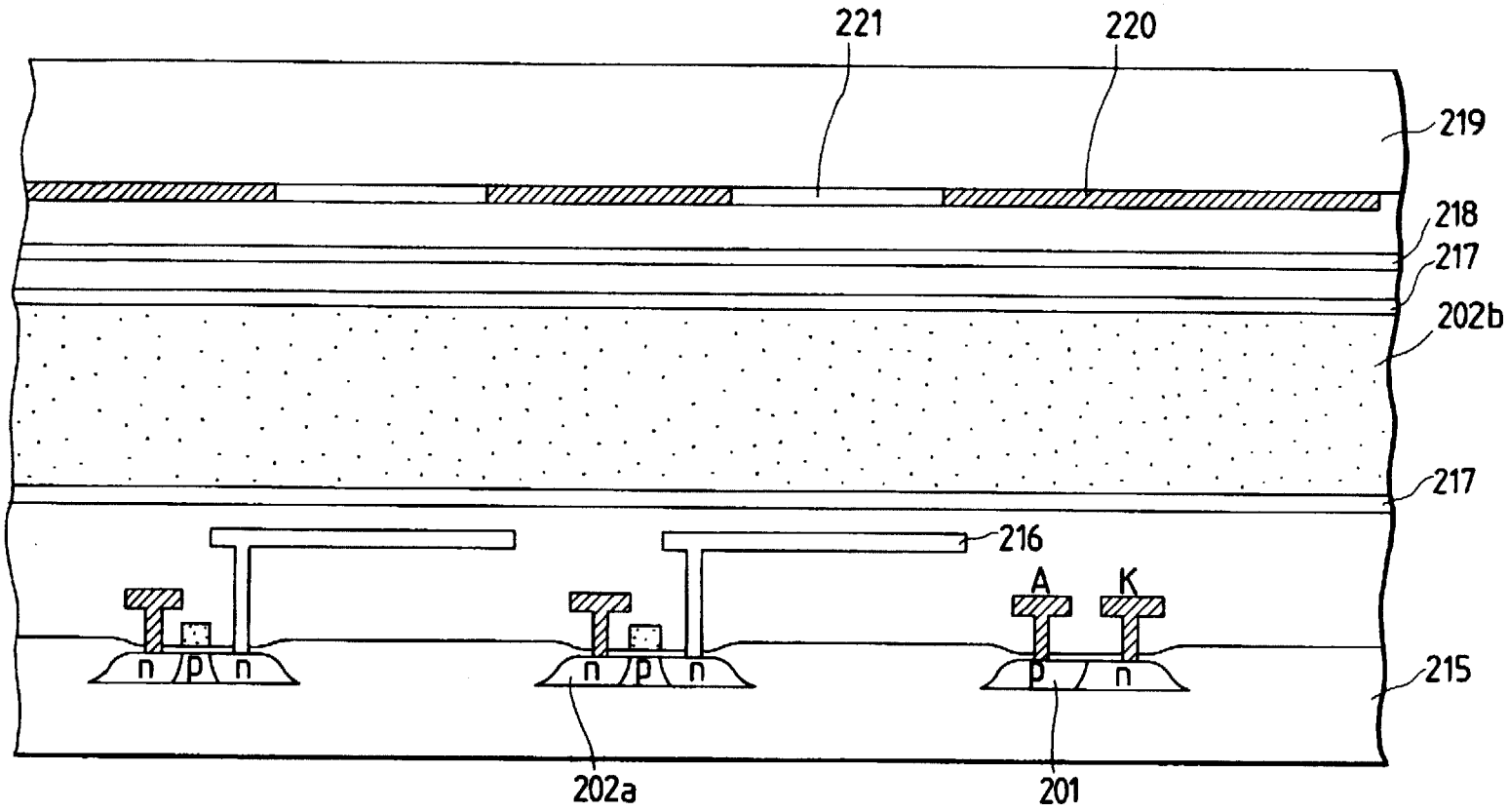
FIG. 9 is a cross-sectional view of the periphery around a temperature detection element in the display unit.

As clearly shown in FIG. 9, the temperature detection element 201 is optimally a diode which is manufactured in the same process as the drive transistor **202*a*, and preferably is formed as close to the pixels 202 as possible. Note that in FIG. 3, A is an anode, K is a cathode, 215 is a transparent insulation layer, 216 is a pixel electrode, 217 is an orientation layer, 218 is a common electrode, 219 is a transparent substrate, 220 is a light shielding layer, and 221** is a color filter.

The temperature detection element 201 detects the temperature of the display unit 209, and is connected to a temperature detection circuit 213 as shown in FIG. 7. The temperature detection circuit 213 is a circuit for converting the output of the temperature detection element 201 to the voltage, for example, consisting of a circuit as shown in FIG. 9.

Figure 10:
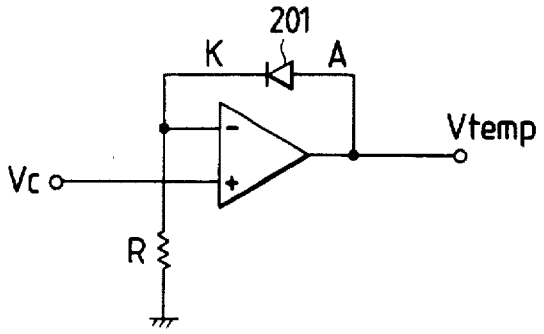
FIG. 10 is an explanation diagram of a temperature detection circuit.
Figure 11:
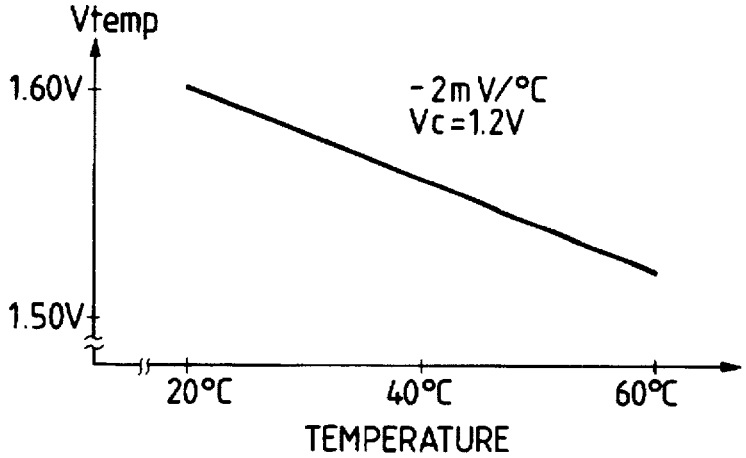
FIG. 11 is a graph showing the characteristic of the temperature detection circuit as shown in FIG. 10.

The temperature detection circuit 213 as shown in FIG. 10 uses a diode as the temperature detection element 201 to flow a current of $V_C/R$ to this diode using a virtual ground and detect the potential $V_{A-K}$ between anode A and cathode K. The characteristic of the output $V_{temp}$ of the temperature detection circuit 213 of FIG. 10 is as shown in FIG. 11, wherein $V_{temp} = V_C + V_{A-K}$, $V_{A-K}$ has the temperature characteristic of about −2 mV/° C., whereby the temperature detection circuit can be utilized for a thermometer.

The temperature detection circuit 213 is connected to the bias circuit 205 and the γ-transformation control circuit 204.

Figure 13:
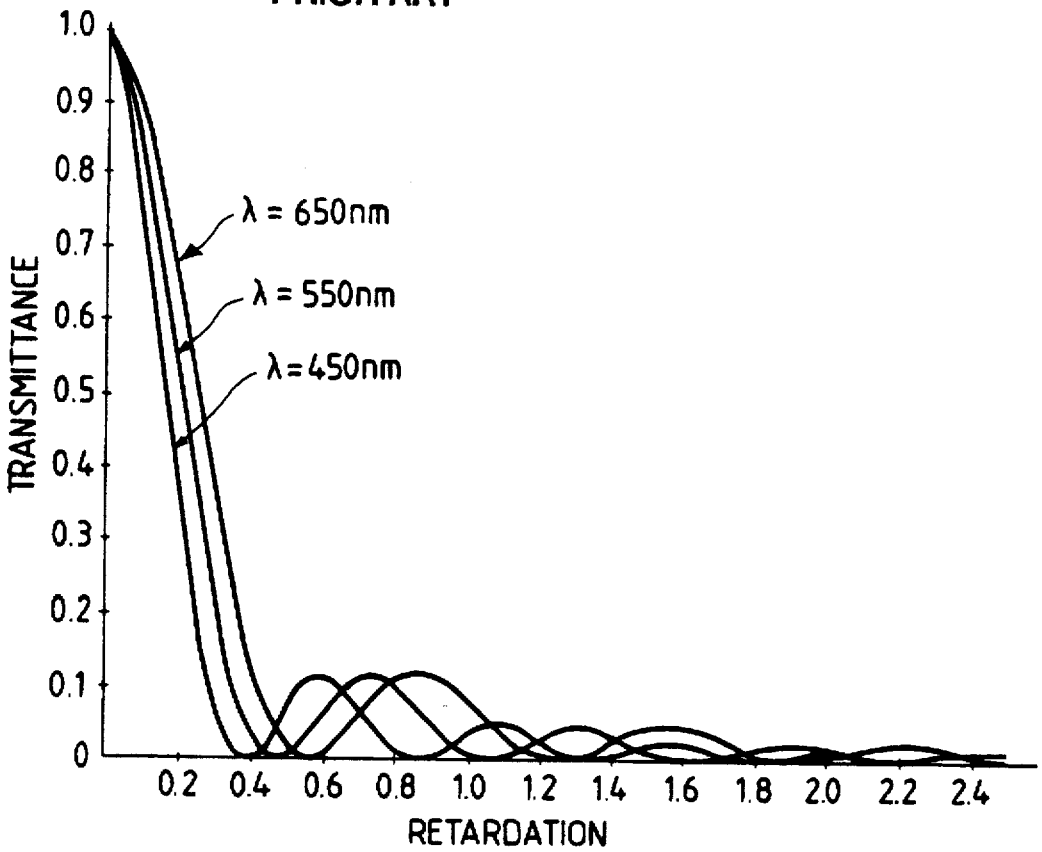
FIG. 13 PRIOR ART
FIG. 13 is graphs showing the relation between the retardation and transmittance of liquid crystal.
Figure 14:
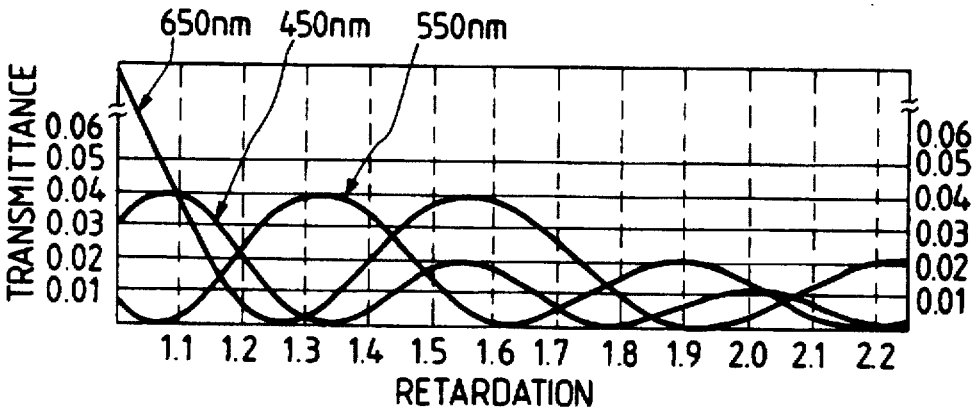
FIG. 14 PRIOR ART
FIG. 14 is partially enlarged graphs of those as shown in FIG. 12.

The reason why the bias circuit 205 is connected to the temperature detection circuit 213 is that three primary color lights have different relations between the applied voltage to the pixels 202 and the transmittance, as described in FIGS. 13 and 14. The bias circuit 205 connected to the temperature detection circuit 213 applies a bias voltage, corresponding to a voltage area where the transmittance of the liquid crystal does not change to each of three primary color signals by determining the voltage area or range from each relation between the applied voltage to the pixels 202 and the transmittance with each of three primary color lights at the temperature detected by the temperature detection element 201.

On the other hand, the γ-transformation control circuit 204 connected to the temperature detection circuit 213 is connected to the γ-transformation circuit 203 as previously described. The γ-transformation control circuit 204 connected to the temperature detection circuit 213 controls the γ-transformation circuits 203 so that the γ-transformation with the γ-transformation circuits 203 may be made in accordance with the temperature detected by the temperature detection element 201. That is, the γ-transformation for three primary color signals with the γ-transformation circuits 203 under the control of the γ-transformation control circuit 204 can be made based on each relation between the applied voltage to the pixels 202 and the transmittance with each of three primary color lights at the temperature detected by the temperature detection element 201.

While in the above-described fourth embodiment, the output of the bias circuit 205 is applied to the output of each of the inversion drive circuits 207, it should be noted that the output of the bias circuit 205 may be applied to the output of each of the γ-transformation circuits 203 before the input to the inversion drive circuits 207.

Figure 15:
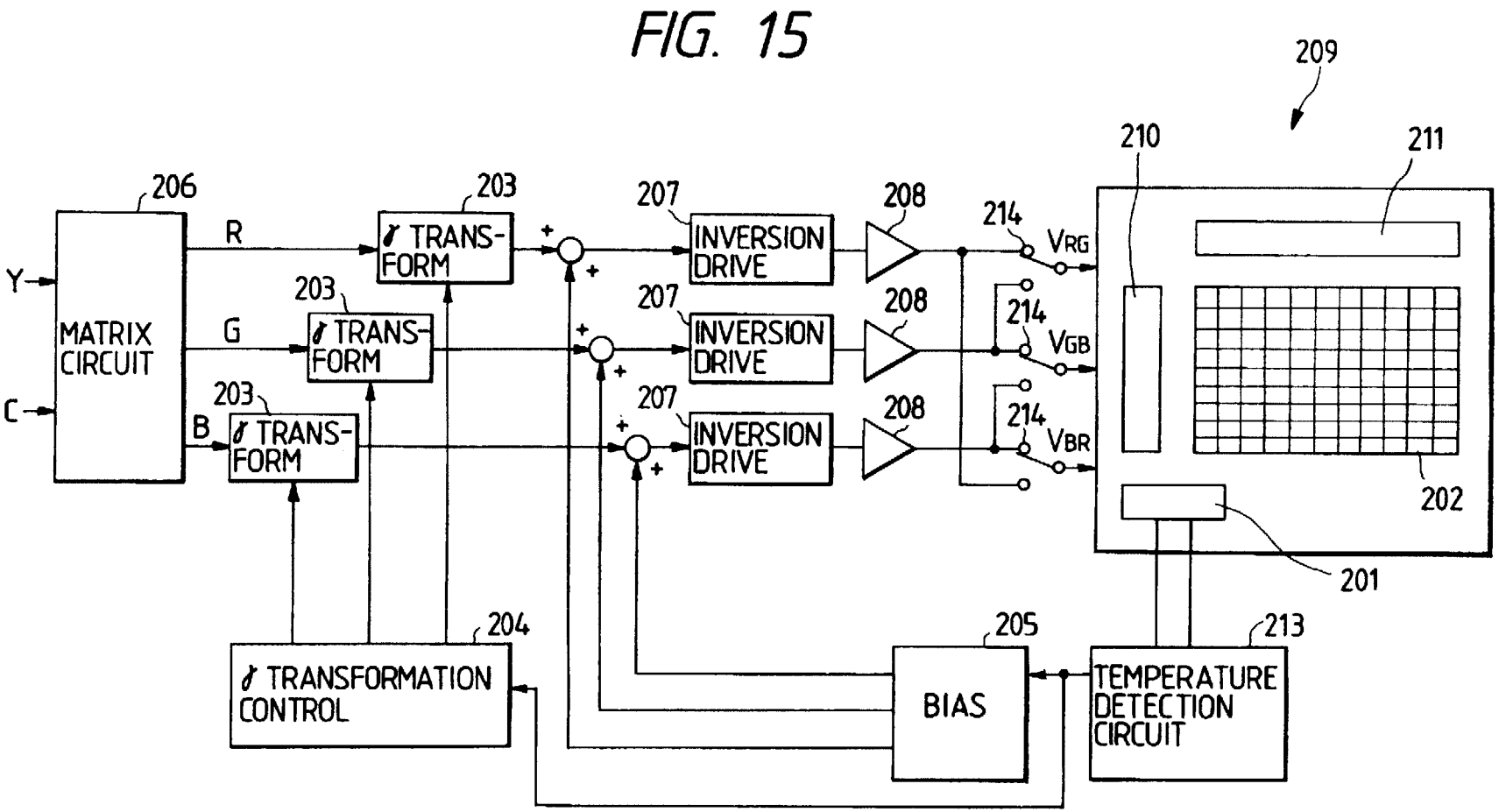
FIG. 15 is a schematic block diagram showing an embodiment of the present invention.
Figure 16:
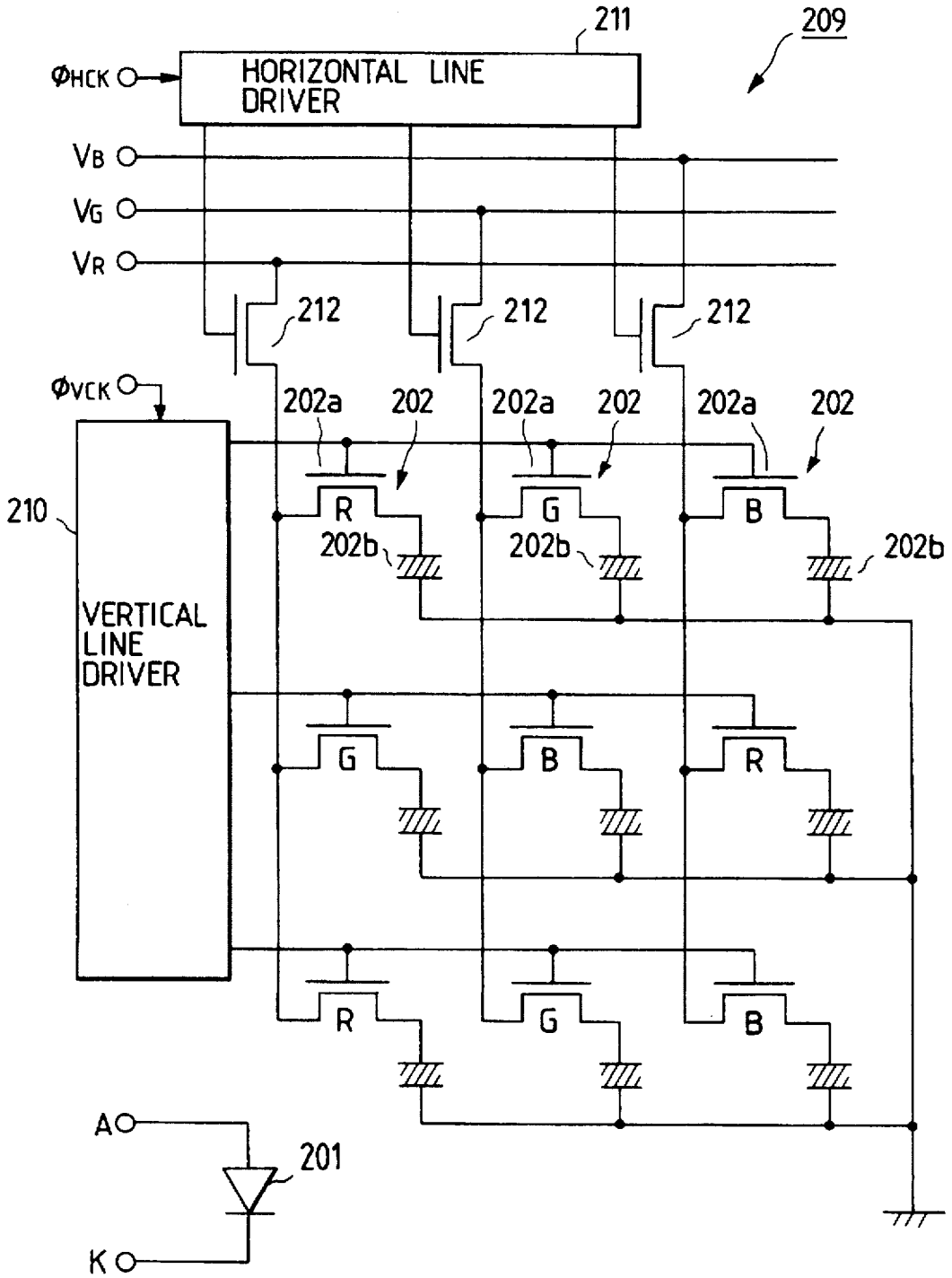
FIG. 16 is an equivalent circuit diagram of a display unit in the liquid crystal display as shown in FIG. 15.

FIGS. 15 and 16 show a fifth embodiment of the present invention, which is the same as the fourth embodiment as previously described, except that the inputs of R and G, G and B, B and R are commonly connected to a display unit 209 in this embodiment, input changeover switches 214 are provided to drive correctly each pixel 202 of R, G, B in the connection state, and a bias circuit 205 is connected-between γ-transformation circuit 203 and inversion drive circuit 207. Also, in the fifth embodiment, input changeover switches 214 are provided between each liquid crystal drive voltage conversion circuit 208 and the display unit 209, but it will be appreciated that they may be provided between γ-transformation circuit 203 and inversion drive circuit 207.

Figure 17:
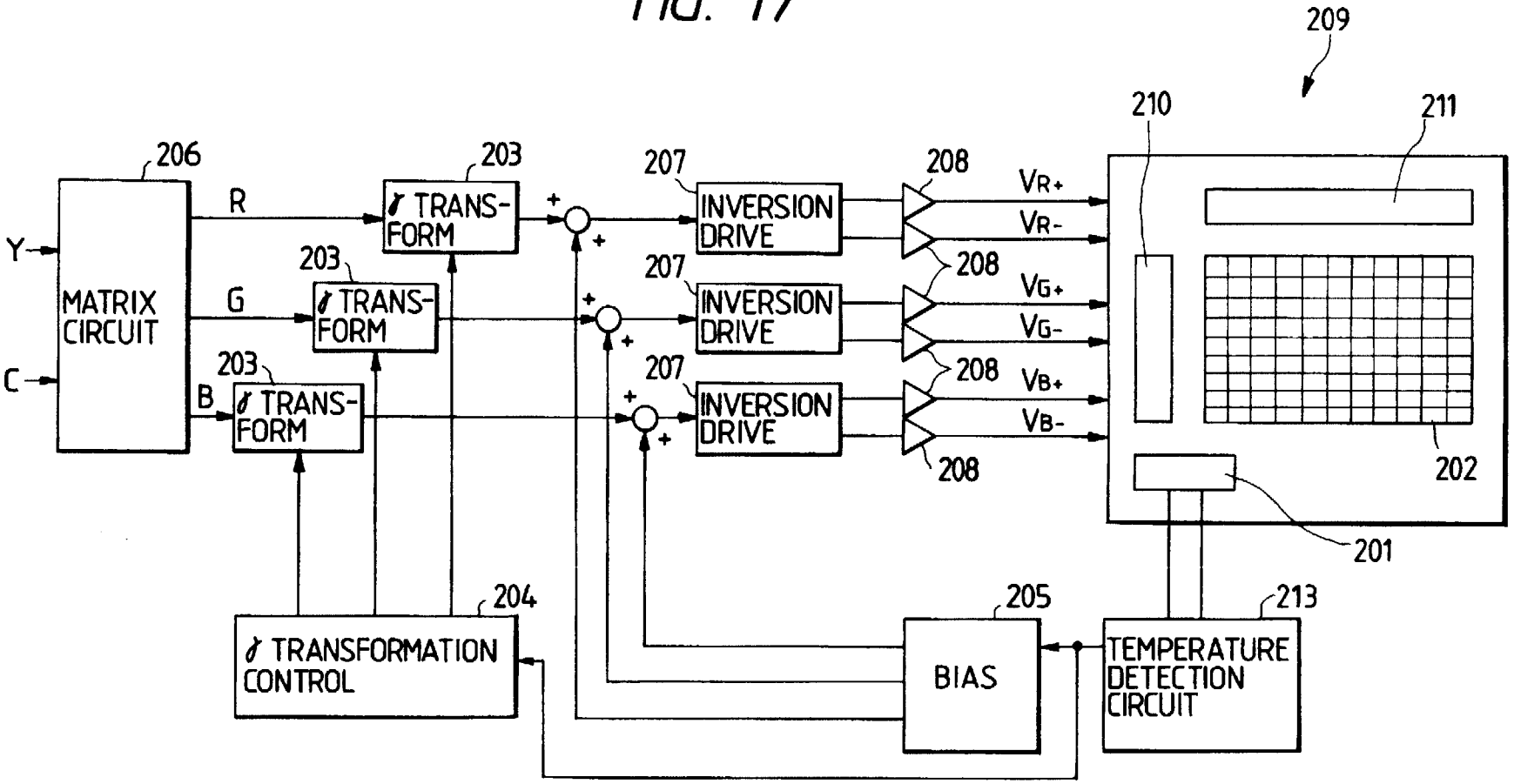
FIG. 17 is a schematic circuit diagram showing an embodiment of the present invention.

FIG. 17 shows a sixth embodiment of the present invention, which is the same as the fifth embodiment, except that a display unit 209 has a total of six input lines, one for driving on the plus side and one for driving on the minus side for each of three primary colors, wherein one input line connects to a respective liquid crystal drive voltage conversion circuit 208 for each of three primary colors on the plus or minus side.

According to the second embodiment of the present invention, because three primary color signals can be input after making the optimal automatic adjustment in accordance with the temperature change, it is possible to automatically obtain high quality image without regards to the temperature change.

Figure 18:
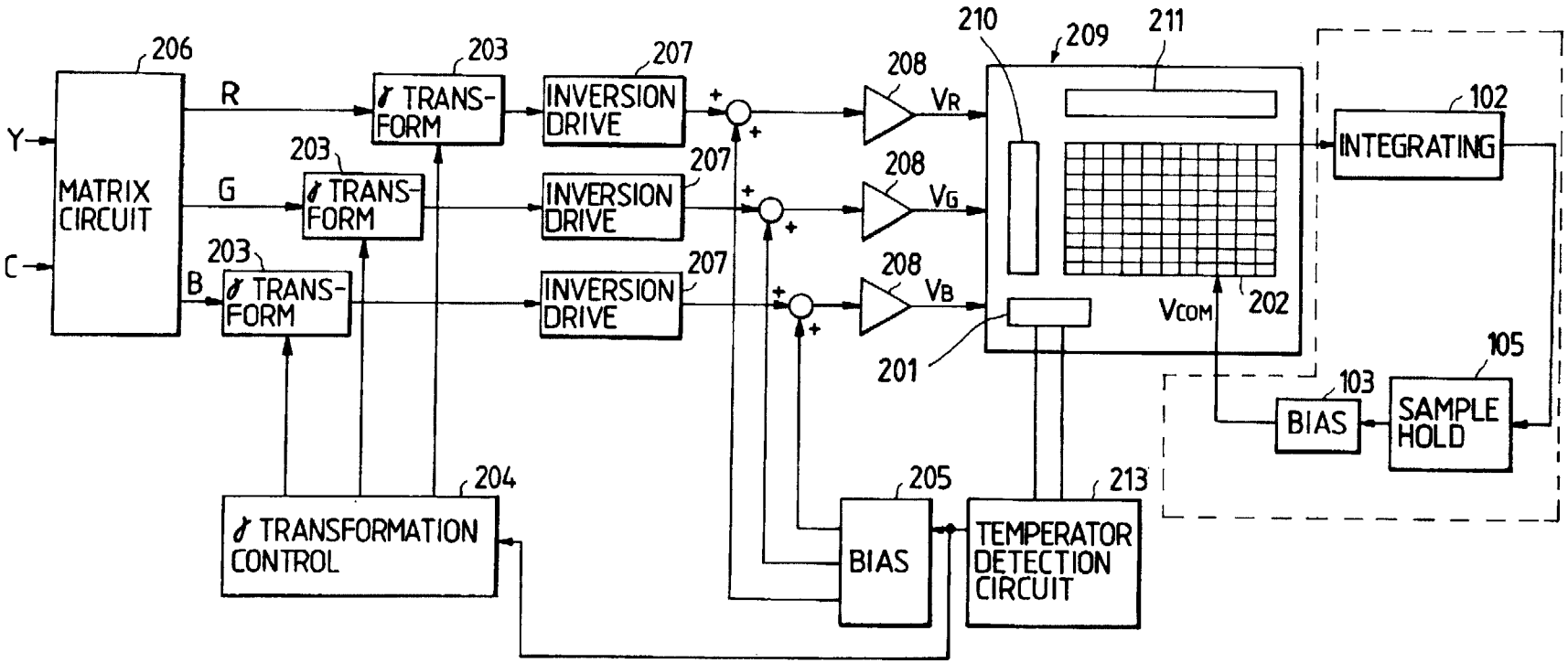
FIG. 18 is a schematic circuit diagram showing an embodiment of the present invention.

FIG. 18 is a schematic circuit diagram showing a seventh embodiment of the present invention. In FIG. 18, a liquid crystal display consists of an integration circuit 102, a sample and hold circuit 105, and a bias circuit 103 as shown in FIG. 1, which are incorporated into the liquid crystal display of FIG. 7.

That is, in FIG. 18, a liquid crystal display is shown having the constitution for both the liquid crystal displays of the first embodiment and the second embodiment. With the liquid crystal display thus constituted, the effects from the first and second embodiments of the invention can be simultaneously obtained, whereby quite excellent display image can be stably obtained.

The liquid crystal display having the constitution for both the first and second embodiments of the invention is not limited to that shown in FIG. 18, but it will be appreciated that it may be appropriately constituted without departing from the scope of the claimed invention.

What is claimed is:

1. A liquid crystal display comprising:

a plurality of pixels each including a liquid crystal, a pixel electrode and a common electrode, wherein said liquid crystal is sandwiched between said pixel electrode and said common electrode, and said pixel electrode is driven by a voltage that is inverted periodically;

a monitoring pixel for monitoring a voltage applied thereto;

an integrating circuit for integrating the voltage applied to the monitoring pixel according to an inversion period; and a bias circuit for applying to the common electrode of said monitoring pixel, a bias voltage regulated so that a result of the integration becomes zero, wherein said liquid crystal display further comprises:

a liquid crystal display unit including a liquid crystal driven by three primary color image signals;

a temperature detection element for detecting a temperature of said liquid crystal display unit;

a γ-transformation circuit for γ-transforming each of the three primary image color signals independently;

a γ-transformation control means for controlling the γ-transformation for each of the three primary color image signals independently, based on a relation between transmittance for each of three primary color lights corresponding to the three primary color image signals and a voltage applied to the liquid crystal, according to the temperature detected by said temperature detection element; and a second bias circuit for combining the three primary color image signals with a second bias voltage regulated independently for each of the three primary color image signals, based on the relation between transmittance for each of the three primary color lights and the voltage applied to the liquid crystal, according to the temperature detected by said temperature detection element, so that transmittance characteristics of the liquid crystal do not change with temperature.

2. An active matrix liquid crystal display comprising:

a first substrate provided with plural pixel electrodes arranged in a matrix configuration;

plural driving transistors connected respectively to said plural electrodes;

a second substrate arranged in opposition to said first substrate, wherein a common electrode connected to a common voltage is provided on said second substrate;

a liquid crystal layer sandwiched between said first and second substrates;

a driving circuit for supplying said pixel electrodes through said driving transistors with a driving signal of which plurality is inverted per a predetermined period;

a bias circuit for adding a bias voltage to the common voltage to apply them to said common electrode;

an integrated circuit for integrating for the predetermined signal period a voltage between said common electrode provided with the bias voltage and said pixel electrode supplied with the driving signal, and for outputting the integrated value; and a feedback control circuit for feedback of the output from said integrating circuit into said bias circuit, thereby controlling the bias voltage at a value according to the output from said integrating circuit.

3. A display according to claim 2, wherein said feedback control circuit comprises a sample hold circuit provided between said integrating circuit and said bias circuit.

4. An active matrix liquid crystal display comprising:

a first substrate provided with plural pixel electrodes arranged in a matrix configuration;

plural driving transistors connected respectively to said pixel electrodes;

a second substrate arranged in opposition to said first substrate, wherein a common electrode connected to a common voltage is provided on said first substrate;

a liquid crystal layer sandwiched between said first and second substrates;

a bias circuit for adding a bias voltage to a driving signal of which polarity is inverted per a predetermined period;

a driving circuit for supplying the driving signal to which the bias voltage is added to said pixel electrodes through said driving transistors;

an integrating circuit for outputting a value derived by integrating a voltage between said common electrode and said pixel electrodes to which the driving signal to which the bias voltage is added is supplied; and a feedback control circuit for feedback of the output from said integrating circuit into said bias circuit, thereby controlling the bias voltage at a value according to the output from said integrating circuit.

5. A display according to claim 4, wherein said feedback control circuit comprises a sample hold circuit provided between said integrating circuit and said bias circuit.

* * * * *

UNITED STATES PATENT AND TRADEMARK OFFICE

CERTIFICATE OF CORRECTION

PATENT NO. : 5,748,171

DATED : May 5, 1998

INVENTOR(S) : AKIRA ISHIZAKI, ET AL.

It is certified that error appears in the above-identified patent and that said Letters Patent is hereby corrected as shown below:

IN THE DRAWINGS

Sheet 14, FIG. 18, "TEMPERATOR" should read --TEMPERATURE--.

COLUMN 1

Line 46, "to" should read --for--; and
Line 53, "dissolve troubles" should read --solve the problem--.

COLUMN 2

Line 18, "a-liquid" should read --a liquid--; and
Line 22, "of" should read --of the--.

COLUMN 3

Line 19, "pixel" should read --the pixel--.

COLUMN 5

Line 3, "hold" should read --hold circuit--; and
Line 46, "that-the" should read --that the--.

COLUMN 6

Line 8, "-inversion" should read --inversion--;
Line 53, "$V_{A-K}$, $V_{A-K}$" should read --$V_{A-K}$, and $V_{A-K}$--;
Line 64, "area" should read --area or range--; and
Line 65, "change" should read --change,--.

UNITED STATES PATENT AND TRADEMARK OFFICE

CERTIFICATE OF CORRECTION

PATENT NO. : 5,748,171

DATED : May 5, 1998

INVENTOR(S) : AKIRA ISHIZAKI, ET AL.

It is certified that error appears in the above-identified patent and that said Letters Patent is hereby corrected as shown below:

COLUMN 7

Line 50, "regards" should read --regard--.

Signed and Sealed this

Seventeenth Day of November, 1998

*Attest:*

*Attesting Officer*

BRUCE LEHMAN

*Commissioner of Patents and Trademarks*